US008526661B2

(12) United States Patent
Newberg et al.

(10) Patent No.: US 8,526,661 B2
(45) Date of Patent: Sep. 3, 2013

(54) ARTICULATING SPEAKER

(75) Inventors: Travis Newberg, Columbus, OH (US); Yousuf Riad, Dublin, OH (US); Christopher David Hall, Dublin, OH (US); Michael P. Hullihan, Columbus, OH (US); Joshua Kramer, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 184 days.

(21) Appl. No.: 13/105,209

(22) Filed: May 11, 2011

(65) Prior Publication Data

US 2012/0288134 A1 Nov. 15, 2012

(51) Int. Cl.
*H04R 1/02* (2006.01)

(52) U.S. Cl.
USPC ..... 381/387; 381/389; 381/390; 248/27.1

(58) Field of Classification Search
USPC ..... 381/385–387, 389–390; 248/27.1; 181/150
See application file for complete search history.

(56) References Cited

U.S. PATENT DOCUMENTS

| | | | | |
|---|---|---|---|---|
| 4,441,577 | A | 4/1984 | Kurihara | |
| 5,321,760 | A | 6/1994 | Gray | |
| 5,859,917 | A | 1/1999 | Silber et al. | |
| 6,343,135 | B1 | 1/2002 | Ellero et al. | |
| 7,077,236 | B2 | 7/2006 | Sleboda et al. | |
| 2006/0208062 | A1 * | 9/2006 | Osborn et al. | 235/380 |
| 2007/0025580 | A1 | 2/2007 | Reardon et al. | |
| 2007/0080264 | A1 | 4/2007 | Kukucka et al. | |
| 2009/0121508 | A1 * | 5/2009 | Balcerzak et al. | 296/1.08 |

OTHER PUBLICATIONS

Article entitled 2007 Jeep Compass: Liftgate Speakers. Sep. 13, 2007 by Brent Romans. Located at http://blogs.insideline.com/roadtests/2007/09/2007-jeep-compass-liftgate-speakers.html.

* cited by examiner

*Primary Examiner* — Curtis Kuntz
*Assistant Examiner* — Joshua Kaufman
(74) *Attorney, Agent, or Firm* — Fay Sharpe LLP

(57) ABSTRACT

An articulating speaker assembly for a sound system of a vehicle includes a speaker that is mounted in a trim panel of the vehicle and is movable from a first stowed position corresponding to a typical vehicle speaker location to a deployed position wherein the speaker is configured to direct sound towards an exterior of the vehicle. In one embodiment, the articulating speaker is generally flush with the trim panel when it is in the stowed position, and when it is in the deployed position, is rotated approximately 90° and spaced apart from the trim panel.

10 Claims, 2 Drawing Sheets

ARTICULATING SPEAKER

BACKGROUND

The present exemplary embodiment relates to vehicle sound systems. It finds particular application in conjunction with articulating speakers, and will be described with particular reference thereto. However, it is to be appreciated that the present exemplary embodiment is also amenable to other like applications.

Minivans and sport utility vehicles, among other types of vehicles, are often used at sporting events, concerts, and other gatherings for tailgating. Tailgating often includes opening a tailgate or rear door of a vehicle. The rear of the vehicle is often used as a central platform for carrying out the tailgating activities including the provision of food and beverages, seating, etc. Often, music or other audio will be played through the vehicle's stereo system for the enjoyment of the tailgate participants.

Vehicle stereo systems typically are configured to provide the interior of the vehicle with the best sound possible. Accordingly, the speakers of the stereo system are generally directed towards the interior of the vehicle and, in particular, placed at strategic positions to provide the best sound to occupants seated inside the vehicle. Thus, when using the stereo system in a tailgate setting, the volume of the stereo system is often turned to a relatively high level so that the sound emanating from the speakers of the stereo system is audible by the tailgate participants outside of the vehicle. This can result in uncomfortable sound levels to any person inside of the vehicle, and in some cases, depending on the stereo system, may cause the audio signal to be at least somewhat distorted. The need to increase the volume level is at least in part due to the orientation of the speakers towards the interior of the vehicle.

BRIEF DESCRIPTION

An articulating speaker assembly for a sound system of a vehicle includes a speaker that is mounted in a trim panel of the vehicle and is movable from a first stowed position corresponding to a typical vehicle speaker location to a deployed position wherein the speaker is configured to direct sound towards an exterior of the vehicle. In one embodiment, the articulating speaker is generally flush with the trim panel when it is in the stowed position, and when it is in the deployed position, is rotated approximately 90° and spaced apart from the trim panel.

In accordance with one aspect, a vehicle comprises a trim panel, an opening in a surface of the trim panel, a speaker including a speaker housing, and a pivoting support arm mounted adjacent the opening of the surface of the trim panel. The pivoting support arm supports the speaker housing for movement between a stowed position where at least a portion of the speaker housing is received in the opening of the trim panel, and a deployed position where the speaker housing is spaced apart from the opening and the surface of the trim panel.

The pivoting support arm can extend transversely from the trim panel and supports the speaker housing in spaced relation to the surface of the trim panel in the deployed position. A locking mechanism for locking the pivoting support arm in a position corresponding to at least one of the stowed and deployed positions of the speaker housing can be provided. The trim panel can further include a support arm recess, wherein the support arm is received in the support arm recess when the speaker housing is in the stowed position. The pivoting support arm can be hingedly attached to the trim panel and the trim panel can include at least one interference protrusion extending from an edge of the support arm recess for restricting movement of the pivoting support arm from the pivoting support arm recess. The support arm recess can be an elongated shape and the interference protrusion can include a necked down portion of an opening to the support arm recess.

When the speaker housing is in the stowed position, a face of the speaker can be substantially flush with the surface of the trim panel surrounding the opening. Further, when the speaker housing is in the stowed position, a face of the speaker can be substantially coplanar with the surface of the trim panel surrounding the opening, and when the speaker housing is in the deployed position, the face of the speaker can be substantially orthogonal and spaced apart from the surface of the trim panel surrounding the opening.

The pivoting support arm can include a telescoping portion thereof whereby the speaker housing, when in the deployed position, can be spaced apart from the trim panel a variable distance. The opening in the surface of the trim panel can be defined by edges of a recess in the surface of the trim panel. The pivoting support arm can be formed integrally with the housing of the speaker.

In accordance with another aspect, an articulating speaker assembly for a vehicle comprises a trim panel mountable to a vehicle and including an opening, a speaker having a housing adapted to be at least partially received in the opening of the trim panel, a pivoting support arm mounted to the trim panel adjacent the opening in the trim panel and operatively coupled to the speaker for supporting the speaker for movement between a stowed position where at least a portion of the housing is received in the recess of the trim panel and a deployed position where the housing is spaced apart from the opening and the surface of the trim panel.

The pivoting support arm can extend transversely from the trim panel and supports the speaker housing in spaced relation to the surface of the trim panel in the deployed position. The assembly can further include a locking mechanism for locking the pivoting support arm in a position corresponding to at least one of the stowed and deployed positions of the speaker housing. The trim panel can include a support arm recess wherein the support arm is received in a support arm recess when the speaker housing is in the stowed position. The pivoting support arm can be hingedly attached to the trim panel, and the trim panel can include at least one interference protrusion extending from the edge of the support arm recess, the interference protrusion restricting movement from the pivoting support arm from the pivoting support arm recess. The support arm recess can be elongated in shape and the interference protrusion can include a necked-down portion of an opening to the support arm recess. The pivoting support arm can be formed integrally with the housing of the speaker. The opening in the surface of the trim panel can be defined by edges of a recess in the surface of the trim panel.

DETAILED DESCRIPTION

Figure 1:
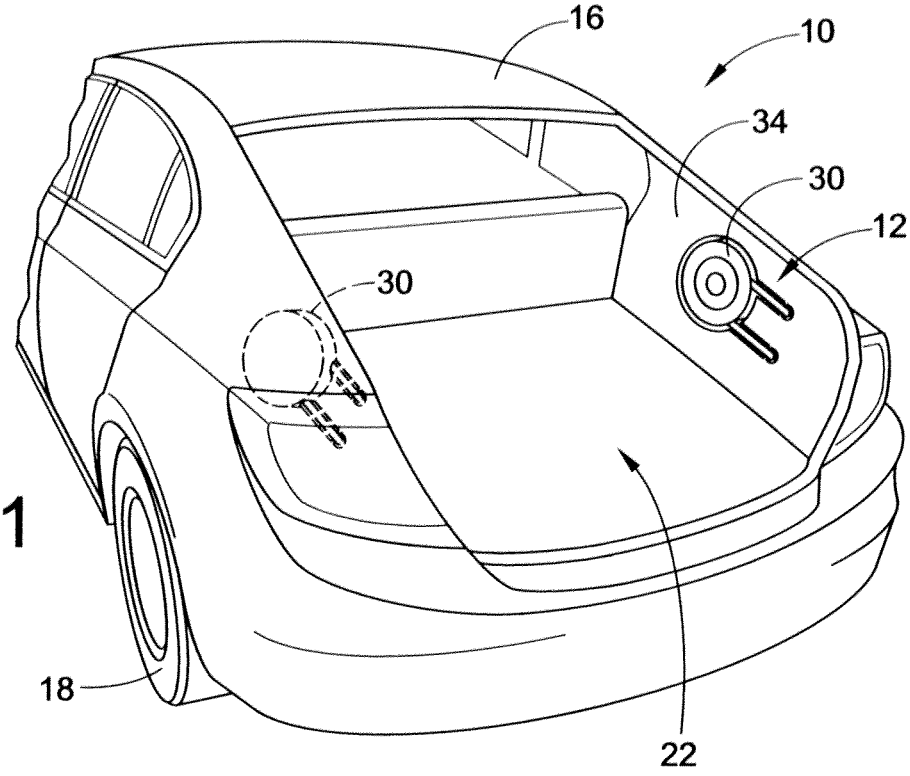
FIG. 1 is a perspective view of an exemplary vehicle including a pair of articulating speaker assemblies in a stowed position in accordance with the disclosure.
Figure 2:
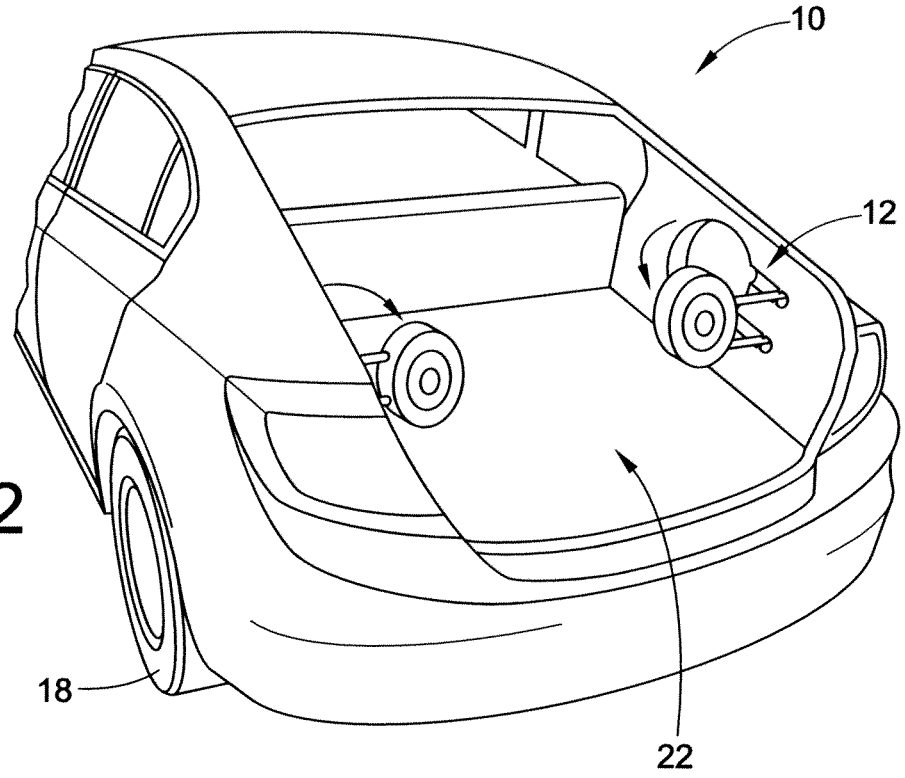
FIG. 2 is a perspective view of the vehicle of FIG. 1 with the articulating speaker assemblies shown in a deployed position.

Turning now to the drawings and initially to FIGS. 1 and 2, an exemplary vehicle 10 including an articulating speaker assembly 12 is illustrated. The vehicle generally includes a body 16 having a plurality of body panels and windows, supported on a frame (not shown) and a plurality of wheels 18. The body 16 generally defines an interior space 22 (e.g., a cabin) of the vehicle 10 in which, as is conventional, a stereo system (not shown) is provided.

A typical stereo system includes a head unit located in a dashboard of the vehicle and a plurality of speakers located throughout the cabin of the vehicle. In a typical passenger vehicle stereo system, at least a pair of speakers are installed in the front driver/passenger doors, and often a pair of rear speakers are installed in the trim panels (also referred to as garnish) in the rear portion of the cabin. In the past, the speakers were "hard-mounted" within the vehicle and not repositionable.

In accordance with the present disclosure, the illustrated embodiment includes a pair of articulating rear speakers 30 mounted in respective trim panels 34 of the right and left sides of the vehicle 10. In FIG. 1, only one speaker 30 (the rear right side speaker) is visible and is shown in a stowed position. In the stowed position, the rear speakers 30 are received in recesses in their respective trim panels 34 and are generally flush with an interior facing surface of the trim panels 34. In this position, the speakers 30 are not unlike typical hard-mount speakers used in the past.

With reference to FIG. 2, the articulating speakers 30 are illustrated in a deployed position wherein they have been rotated approximately 90° from their stowed position of FIG. 1 and now face the rear of the vehicle 10. In the position shown in FIG. 2, the speakers 30 now direct sound towards the exterior of vehicle 10, which can enhance the quality of sound for listeners exterior to the vehicle 10. The speakers 30 are moveable between the stowed and deployed position whenever it is desired to direct sound towards the rear/exterior of the vehicle 10.

Figure 3:
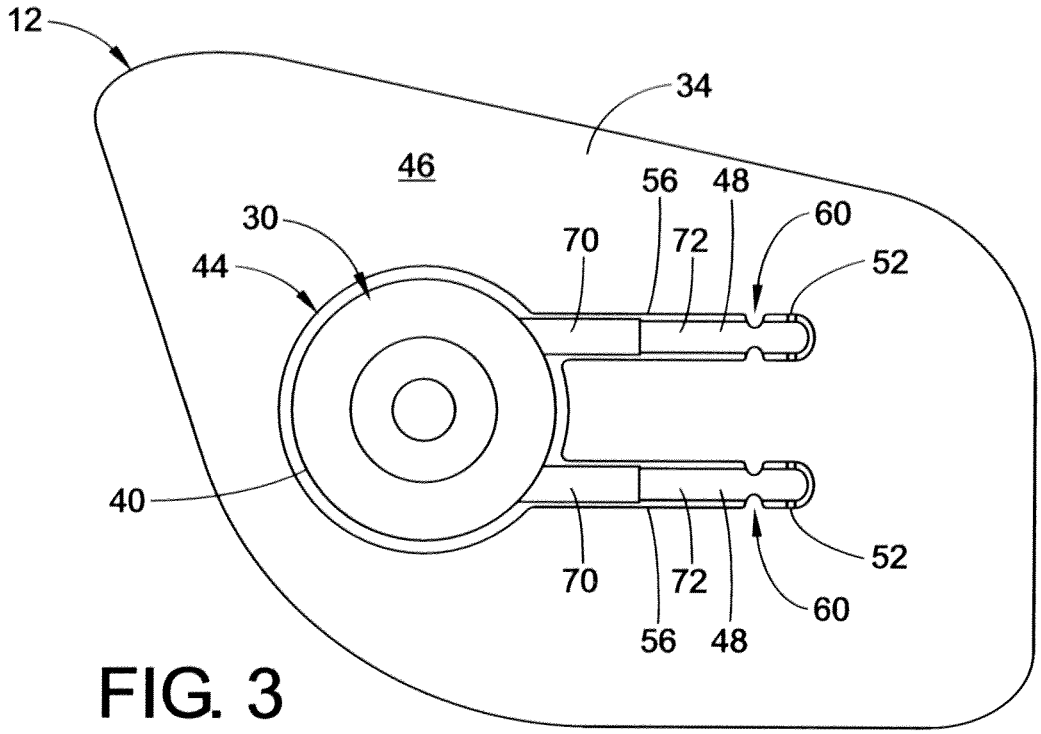
FIG. 3 is an enlarged view of an exemplary articulating speaker assembly in a stowed position in accordance with the disclosure.
Figure 4:
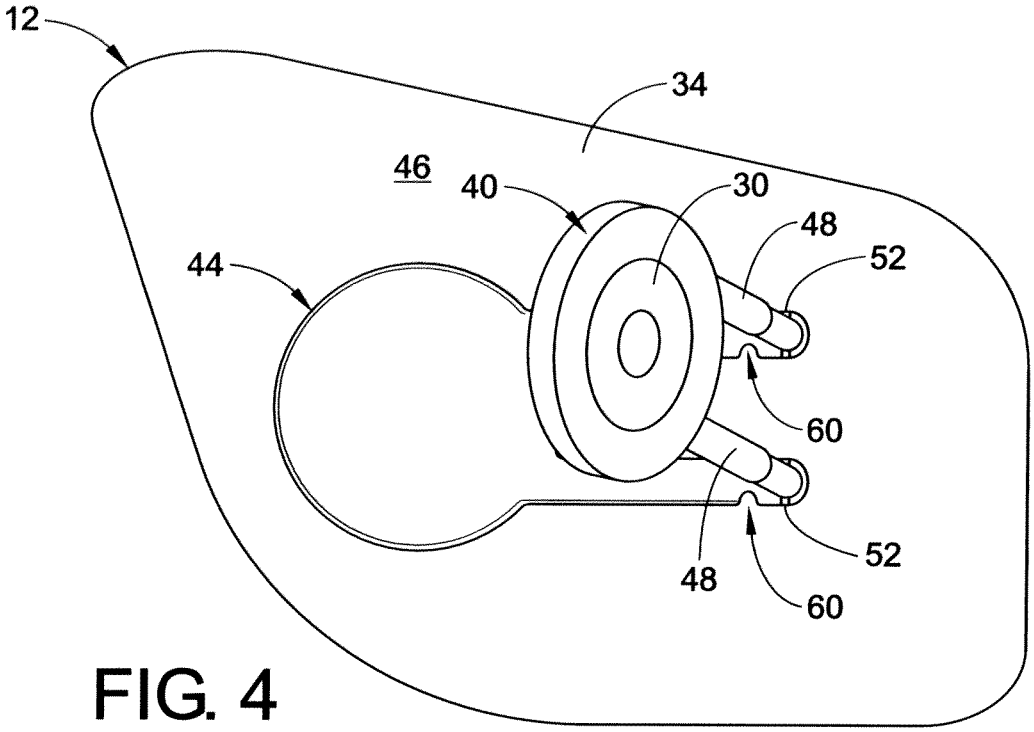
FIG. 4 is a perspective view of the articulating speaker assembly of FIG. 3 in a deployed position.

With reference now to FIGS. 3 and 4, the details of an articulating speaker assembly 12 will be described. The articulating speaker assembly 12 generally includes a trim panel, such as trim panel 34 and the speaker 30 which is supported in a speaker housing 40. The speaker housing 40 is adapted to be at least partially received in an opening 44 in the trim panel 34. To this end, the opening 44 and the housing 40 have a corresponding shape and, in the illustrated embodiment, this shape is circular. Of course, other shape speaker/openings could be used without departing from the scope of this disclosure. The opening 44 can be a hole in an interior facing surface 46 of the trim panel 34. In another embodiment, the opening 44 can be an opening to a recess or depression in the surface 46 of the trim panel 34 (e.g., merely a depression in the surface 46 of the trim panel and not a hole extending completely through the trim panel). The interior of the recess or depression can have a finish similar or the same as that of the interior surface 46 of the trim panel 34, such that when the speaker 30/speaker housing 40 is not in the stowed position, the trim panel 34 still provides a finished look to the interior of the cabin.

The speaker 30 and speaker housing 40 are supported for movement by a pair of pivoting support arms 48 that are mounted to the trim panel 34 adjacent the opening 44. The pivoting support arms 48 support the speaker housing 44 for movement between the stowed position (FIG. 3) where at least a portion of the speaker housing 40 is received in the opening 44 in the trim panel 34, and a deployed position (FIG. 4) where the speaker housing 40 is spaced apart from opening and/or the trim panel 34. In the deployed position, the pivoting support arms 48 extend transversely from the trim panel 34 and support the speaker housing 40 in spaced relation to the trim panel 34. In one embodiment, the speaker housing 40 and the pivoting support arms can be formed together as a unitary structure made of plastic or the like. Although two support arms are illustrated in the exemplary embodiment, in some applications a single support arm may be preferred.

To movably support the speaker housing 40 for movement between the stowed and deployed positions, each pivoting support arm 48 is hingedly secured to the trim panel 34 via hinge members 52 that permit the pivoting support arms to swing away from the trim panel. The hinge members 52 can be a post and socket hinge, ball and socket hinge, or any other suitable hinge member. A ball and socket hinge could be used in some embodiments to permit the speaker housing 40 to be moved vertically as well as horizontally.

In the illustrated embodiment, the trim panel 34 includes support arm recesses 56 that are adapted to receive the pivoting support arms 48 when the speaker housing 40 is in the stowed position thus providing a generally flush and finished appearance to the trim panel 34 and/or articulating speaker assembly 12 when the speaker is stowed. The support arm recesses 56 are generally elongated recesses that have a shape and size adapted to accommodate the pivoting support arms 48. As will be appreciated, a single recess large enough to accommodate both pivoting support arms 48 could be provided. To this end, the pivoting support arm recesses 56 could be made integral with a speaker recess defined by opening 44 and, thus, a single larger and appropriately shaped recess could be provided for accommodating the speaker housing 40 along with the pivoting support arms 48.

As will now be appreciated, the present disclosure provides a speaker 30 that is moveable between at least two positions (e.g., stowed and deployed) depending on the needs of the user. In some instances, it may be desirable to lock or otherwise restrict movement of the speaker 30. For example, it may be useful to lock or otherwise secure the speaker assembly in the stowed and/or deployed positions to avoid the speaker housing 40 from swinging during operation of the vehicle 10.

Accordingly, the exemplary articulating speaker assembly 12 further includes a locking mechanism for locking the pivoting support arms 48 in the stowed and/or deployed positions. The locking mechanism in the illustrated embodiment is in the form of a pair of interference protrusions 60 provided on the trim panel 34 at each support arm recess 56. As illustrated in FIG. 3, each pair of interference protrusions 60 act to secure the respective pivoting support arm 48 within the support arm recess 56 when the speaker housing 40 is in the stowed position. That is, when the pivoting support arms 48 are received within the support arm recesses 56, the interference protrusions 60 partially surround and/or capture the support arms 48 thereby restricting movement of the pivoting support arms 48 from the pivoting support arm recesses 56.

Similarly, with reference to FIG. 4, when the speaker housing 40 is moved to the deployed position, the interference protrusions 60 of each pivoting support arm recess 56 engage the respective pivoting support arm 48 and restrict movement of the pivoting support arms 48 from their deployed position. As will be appreciated, the interference protrusions 60 therefore both secure the speaker housing 40 in the stowed position as well as secure the speaker housing 40 in the deployed position.

The interference protrusions 60 can be formed integrally as part of the trim panel 34. In this regard, the protrusions 60 can be a necked-down portion of a given support arm recess 56. The protrusions 60 can be resilient so as to deflect and allow the support arm 48 to enter/exit the support arm recess 56 when sufficient force is applied to the support arm 48 and/or speaker housing 40.

In one embodiment, the pivot support arms 48 can include first and second parts 70 and 72 that telescope together to allow the speaker housing 40 to be spaced apart from the trim panel a desired amount. The telescoping support arms can also reduce the overall size of the articulating speaker assembly by reducing the length of the pivot arms when in the stowed position to a minimum. For example, the pivoting support arms 48 are illustrated in a retracted position in FIG. 3, and an extended position in FIG. 4.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A vehicle comprising:

a trim panel;

a recess defined in a surface of the trim panel, said recess comprising a first region and a second region;

a speaker including a speaker housing;

a support arm connected to said speaker housing and pivotally mounted adjacent the recess, wherein the support arm supports the speaker housing for movement of the speaker housing and support arm between:

(i) a stowed position where at least a portion of the speaker housing is received in the first region of the recess and at least a portion of the support arm is located in the second region of said recess; and (ii) a deployed position where the support arm extends transversely away from the trim panel and supports the speaker housing at a location that is spaced apart from the recess and the surface of the trim panel, said second region of said recess comprising at least one interference protrusion that extends into and partially blocks said second region of said recess, wherein said at least one interference protrusion restricts movement of the support arm both from its stowed position to its deployed position, and from its deployed position to its stowed position by contact between said support arm and the at least one interference protrusion.

2. A vehicle as set forth in claim 1, wherein the second region of the recess comprises an elongated shape, and the at least one interference protrusion comprises a pair of protrusions that project into said second region and define a necked down portion of the second region, and wherein said support arm deflects said pair of protrusions to enter and exit said second portion of said recess.

3. A vehicle as set forth in claim 1, wherein when the speaker housing is in the stowed position, a face of the speaker housing is substantially flush with a surface of the trim panel surround the first portion of the recess.

4. A vehicle as set forth in claim 1, wherein when the speaker housing is in the stowed position, a face of the speaker housing is substantially coplanar with a surface of the trim panel surrounding the first portion of the recess, and wherein when the speaker housing is in the deployed position the face of the speaker housing is substantially orthogonal and spaced apart from the surface of the trim panel surrounding the recess.

5. A vehicle as set forth in claim 1, wherein the support arm includes a telescoping portion thereof whereby the speaker housing, when in the deployed position, can be spaced apart from the trim panel a variable distance.

6. A vehicle as set forth in claim 1, wherein the support arm is formed integrally with the speaker housing.

7. An articulating speaker assembly for a vehicle comprising:

a trim panel including a recess defined in a surface of the trim panel, said recess comprising a first region and a second region;

a speaker comprising a housing adapted to be at least partially received in the first region of the recess;

a pivoting support arm mounted to the trim panel adjacent the second region of the recess, said support arm connected to the speaker housing and supporting the speaker housing for movement of the speaker housing and support arm between a stowed position where at least a portion of the speaker housing is received in the first region of the recess and at least a portion of the support arm is received in the second region of the recess, and a deployed position where the support arm extends transversely relative to the trim panel and supports the speaker housing at a location spaced apart from the recess and the surface of the trim panel;

said second region of said recess comprising at least one interference protrusion that extends into and partially blocks said second region of said recess, wherein said at least one interference protrusion restricts movement of the support arm both from its stowed position to its deployed position, and from its deployed position to its stowed position by contact between said support arm and the at least one interference protrusion.

8. An articulating speaker assembly as set forth in claim 7, wherein the second region of the recess comprises an elongated shape, and the at least one interference protrusion comprises a pair of protrusions that project into said second region and define a necked down portion of the second region, and wherein said support arm deflects said pair of protrusions to enter and exit said second portion of said recess.

9. An articulating speaker assembly as set forth in claim 7, wherein the support arm is formed integrally with the speaker housing.

10. An articulating speaker assembly as set forth in claim 7, wherein the support arm is selectively telescopically extendable and retractable to define a variable distance between said speaker housing and said trim panel when said speaker housing is located in its deployed position.

* * * * *